United States Patent [19]

Erskine et al.

[11] Patent Number: 4,881,512

[45] Date of Patent: Nov. 21, 1989

[54] INTERNAL COMBUSTION ENGINE IGNITION SYSTEM

[75] Inventors: James C. Erskine, Birmingham; Stephen J. Valeri, Warren, both of Mich.

[73] Assignee: General Motors Corporation, Detroit, Mich.

[21] Appl. No.: 238,656

[22] Filed: Aug. 31, 1988

[51] Int. Cl.[4] ..... F02P 3/01

[52] U.S. Cl. ..... 123/628; 123/643

[58] Field of Search ..... 123/415, 418, 594, 618, 123/628, 649, 651

[56] References Cited

U.S. PATENT DOCUMENTS

| | | | |
|---|---|---|---|
| 2,924,633 | 2/1960 | Sichling et al. | 123/643 |
| 3,880,132 | 4/1975 | Whatley | 123/599 |
| 4,269,161 | 5/1981 | Simmons | 123/594 X |
| 4,296,335 | 10/1981 | Simcoe | 307/584 X |
| 4,296,428 | 10/1981 | Haraszti | 357/41 |
| 4,317,055 | 2/1982 | Yoshida et al. | 307/304 |
| 4,367,421 | 1/1983 | Baker | 307/570 |
| 4,395,726 | 7/1983 | Maeguchi | 357/41 |
| 4,425,518 | 1/1984 | Milberger | 307/571 |
| 4,459,498 | 7/1984 | Stengl et al. | 307/584 |
| 4,487,457 | 12/1984 | Janutka | 307/242 |
| 4,487,458 | 12/1984 | Janutka | 307/577 |
| 4,488,068 | 12/1984 | Janutka | 307/570 |
| 4,490,629 | 12/1984 | Barlow et al. | 307/451 |
| 4,491,750 | 1/1985 | Janutka | 307/577 |
| 4,493,306 | 1/1985 | Asik | 123/643 |
| 4,537,175 | 8/1985 | Gerry | 123/651 X |
| 4,558,242 | 12/1985 | Tuthill et al. | 307/577 |
| 4,738,239 | 4/1988 | Haines et al. | 123/651 |

FOREIGN PATENT DOCUMENTS

| | | | |
|---|---|---|---|
| 3333111 | 3/1985 | Fed. Rep. of Germany | 123/628 |

*Primary Examiner*—Willis R. Wolfe

*Attorney, Agent, or Firm*—C. R. Meland

[57] ABSTRACT

An ignition system for a spark ignited internal combustion engine wherein a source of high direct voltage is connected to a spark plug by a solid-state high voltage switch. The switch comprises a plurality of series connected metal oxide semiconductor field effect transistors which form a first string of series connected transistors. The system has a second string of series connected field effect transistors. The second string is connected in parallel with the spark plug and the second string is biased conductive when the first string is biased non-conductive. The system has a third string of series connected field effect transistors which operate as a voltage level shifter. The individual transistors that form the strings are mounted on common substrates formed of an insulating material such as sapphire.

9 Claims, 2 Drawing Sheets

INTERNAL COMBUSTION ENGINE IGNITION SYSTEM

This invention relates to ignition systems for spark ignited internal combustion engines and more particularly to an ignition system wherein a source of high direct voltage is connected to a spark plug through a high voltage solid-state switch.

Ignition systems for spark ignited internal combustion engines are known wherein a source of voltage is sequentially connected to a plurality of spark plugs by semiconductor devices. Thus, the U.S. Pat. No. to Whatley 3,880,132 discloses an ignition system wherein silicon controlled rectifiers connect a voltage source to the spark plugs. Further, the U.S. Pat. No. to Sichling et al. 2,924,633 discloses an ignition system where magnetically controlled semiconductors are used to connect a source of voltage and the spark plugs.

This invention differs from the above-referenced prior art in that, among other things, it uses high voltage solid-state switches that are comprised of a plurality of series connected metal oxide semiconductor field effect transistors that control the application of a high direct voltage to the spark plugs. By connecting a plurality of transistors in series, the total breakdown voltage across a string of series connected transistors will be equal to the total number of transistors multiplied by the breakdown voltage of a single transistor. Thus, by way of example, if the source of high direct voltage were 40 Kilovolts (40 KV) and the breakdown voltage of a single transistor was 20 volts, somewhat more than 2000 transistors are used to form a string of series connected transistors. It accordingly is one of the objects of this invention to provide an ignition system wherein a source of high direct voltage is connected to a spark plug by a high voltage solid-state switch that is formed from a plurality of series connected metal oxide semiconductor field effect transistors.

Another object of this invention is to provide an ignition system of the type described wherein at least two strings of series connected transistors are utilized. A first string of series connected transistors is connected between a source of high direct voltage and a spark plug. A second string of series connected transistors is connected across the spark plug. The strings of transistors are switched alternately conductive and nonconductive. When it is desired to fire a spark plug, the first string is biased conductive and the second string nonconductive. At other times, when the spark plug is not to be fired, the first string is biased nonconductive and the second string conductive.

Another object of this invention is to provide an ignition of the type described wherein a string of series connected transistors is connected across the source of high direct voltage and wherein this string of transistors is controlled to operate as a voltage level shifter which in turn controls the switching of another string of series connected transistors that are connected between the source of high direct voltage and a spark plug.

Still another object of this invention is to provide ignition systems of the types that have been described wherein the series connected transistors that form a string of transistors are each supported by a common substrate that is formed of insulating material such as sapphire.

IN THE DRAWINGS

Figure 1:
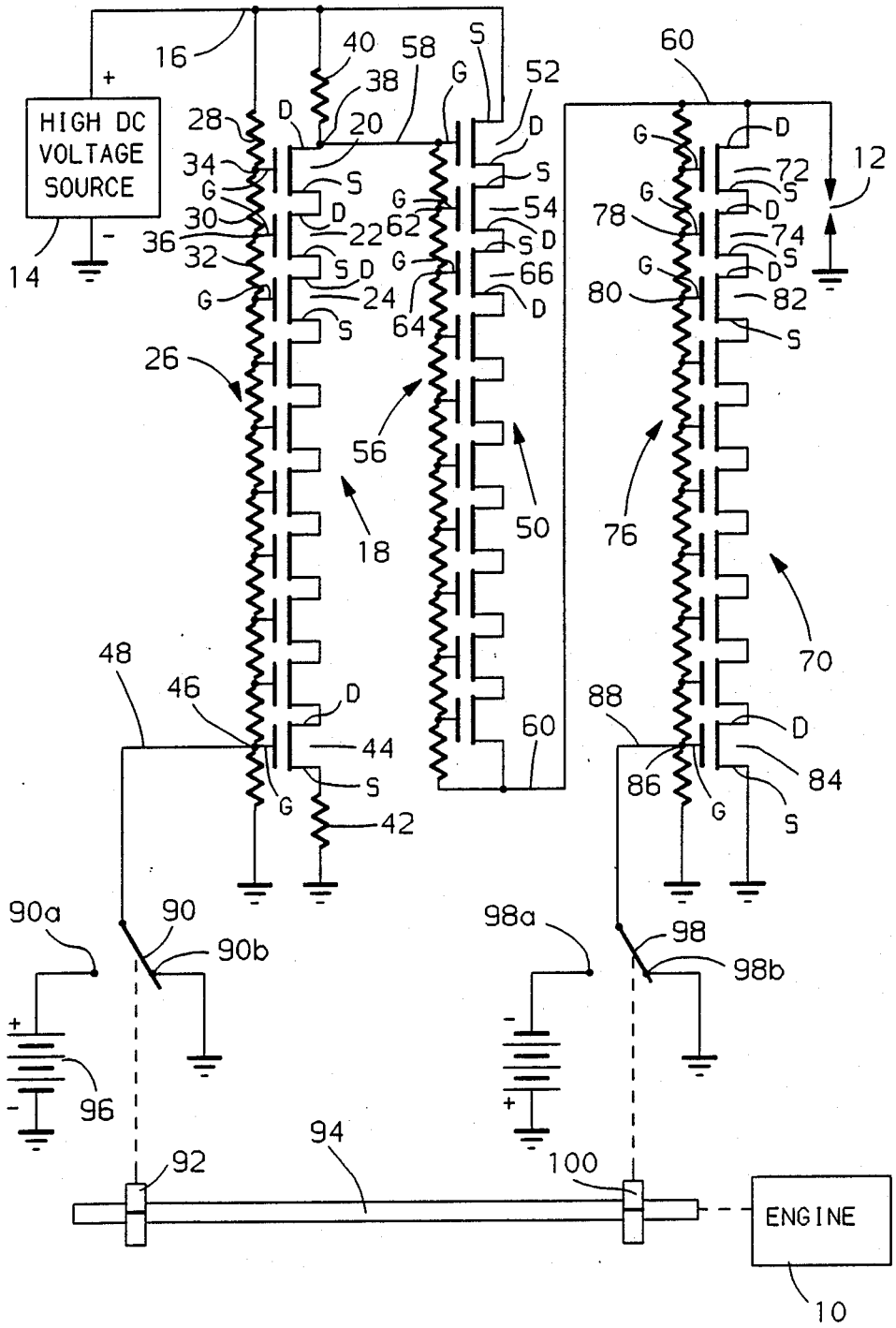
FIG. 1 is a schematic circuit diagram of an ignition system made in accordance with this invention.

Referring now to FIG. 1, the reference numeral 10 designates a spark ignited single cylinder engine. A spark plug 12 is associated with the cylinder of the engine which, when fired, ignites the combustible mixture in the cylinder.

The ignition system shown in FIG. 1 is powered by a high direct voltage source 14. The output voltage of source 14 may be about 30 to 40 KV and in the further description of the FIG. 1 system, the source 14 will be assumed to have a 40 KV direct voltage output. The direct voltage source 14 may take the form of a DC to DC converter that is powered from a low voltage source such as a 12 volt motor vehicle battery. The positive output terminal of direct voltage source 14 is connected to a conductor 16 and its negative output terminal is grounded.

The system of FIG. 1 has a string of series connected metal oxide semiconductor field effect transistors. This string of transistors is generally designated by reference numeral 18. The string of transistors 18 is shown as comprised of ten series connected field effect transistors, three of which have been designated respectively by reference numerals 20, 22 and 24. The source electrode S of a given transistor, for example transistor 20, is connected to the drain electrode D of the next transistor 22 in the string. This connection sequence is the same for all the transistors in the string 18. The transistors that make up the string 18 are all enhancement-mode NMOS or N-channel type of transistors.

The gate electrodes of the transistors that make up the string 18 are connected to junctions or nodes on a resistive voltage divider generally designated as 26. This voltage divider is connected between power supply conductor 16 and ground. The voltage divider 26 is comprised of a plurality of series-connected resistors, three of which are designated respectively as 28, 30 and 32. The resistors that make up the voltage divider 26 have equal resistance values. The junction or node 34 is connected to the gate electrode G of transistor 20 and junction 36 is connected to the gate electrode G of transistor 22. The other junctions of voltage divider 26 are connected to respective gate electrodes of the respective series connected transistors that form string 18.

The drain electrode of transistor 20 is connected to a junction 38 and a resistor 40 is connected between junction 38 and positive power supply conductor 16. A resistor 42 is connected between the source electrode of transistor 44 and ground. The gate G of transistor 44 is connected to junction 46 which in turn is connected to a conductor 48. As will be more fully described hereinafter, the voltage applied to conductor 48 is switched between ground potential and a positive voltage level by a switching circuit that will be described.

Although only ten transistors are shown in FIG. 1, that make up string 18, the actual number of transistors that make up the string 18 will depend upon the magnitude of the output voltage of source 14 and the breakdown voltage of a single transistor from drain to source. The string or chain of transistors 18 is designed so that the total voltage of source 14 is divided among the transistors so that no one transistor supports more than its maximum rated voltage. For example, if the breakdown voltage of each transistor is 20 volts and 2000 transistors are connected in series, the string can support up to 40 KV. Accordingly, if the voltage of source 14 is assumed to be 40 KV, the number of transistors required for string 18 will exceed 2000 transistors.

The system of FIG. 1 has another string of series connected metal oxide field effect transistors. This string of transistors is generally designated by reference numeral 50. The transistors that form the string 50 are all enhancement mode PMOS or P-channel type of transistors. The drain electrode D of a given transistor, for example transistor 52, is connected to the source electrode S of the next transistor 54 in the string. This connection sequence is the same for all the transistors in string 50 The source electrode S of transistor 52 is connected to the positive power supply conductor 16.

The gate electrodes of the transistors that form string 50 are connected respectively to junctions or nodes of a resistive voltage divider generally designated by reference numeral 56. This voltage divider is comprised of a plurality of series connected resistors. The resistors that form the voltage divider 56 have equal resistance values. Two junctions of the voltage divider 56 have been designated respectively as 62 and 64 and these junctions are connected respectively to the gate electrodes of transistors 54 and 66. The conductor 58 is connected to junction 38 and to the gate electrode of transistor 52. The string of transistors 50 is connected between power supply conductor 16 and conductor 60. Further, the voltage divider 56 is connected between conductors 58 and 60.

In FIG. 1, ten series connected transistors are shown that form string 50. The actual number of transistors required for string 50 will again depend upon the total voltage that the string must support. Thus, if the string 50 is to support 40 KV without breakdown and if the breakdown voltage of each transistor is 20 volts, somewhat more than 2000 transistors would be required for string 50.

The system of FIG. 1 has a third string of series connected metal oxide semiconductor field effect transistors, generally designated by reference numeral 70. This string of transistors is connected between conductor 60 and ground. The spark plug 12 is connected between conductor 60 and ground and accordingly the string 70 is connected in parallel with spark plug 12.

The transistors that form string 70 are all depletion mode NMOS or N-channel field effect transistors. The source electrode S of a given transistor, for example transistor 72, is connected to the drain electrode D of the next transistor 74 in the string. This connection sequence is the same for all the transistors in string 70.

The gate electrodes of the transistors that form string 70 are connected respectively to junctions or nodes of a resistive voltage divider generally designated by reference numeral 76. This voltage divider is connected between conductor 60 and ground. The voltage divider is comprised of a plurality of series connected resistors that have equal resistance values. Two junctions of the voltage divider 76 have been respectively designated as 78 and 80 and these junctions are connected respectively to the gate electrodes G of transistors 74 and 82.

The gate of transistor 84, which is a part of string 70, is connected to junction 86 which in turn is connected to a conductor 88. The conductor 88, as will be described, is switched between ground potential and a negative direct voltage level by a switching circuit.

In FIG. 1, string 70 is shown as being formed of ten series connected transistors. The actual number of transistors that form string 70 will, as with the case of strings 18 and 50, depend upon how much voltage must be supported to prevent breakdown and on the breakdown voltage of a single transistor. Thus, when source 14 is a 40 KV source and when the breakdown voltage of each transistor is 20 volts, somewhat in excess of 2000 transistors would be used for string 70.

The operation of the system shown in FIG. 1 will now be described. In this description, a general description will be made first and then a switching circuit will be described that is synchronized with the engine 10 and which controls the switching of the strings 18, 50 and 70 in a predetermined sequence.

The string 18 performs the function of a voltage level shifter to cause the voltage at junction 38 to vary between the voltage on conductor 16 and a voltage that is, for example, 10 volts lower than the voltage on conductor 16. If conductor 16 is at 40 KV the voltage at junction 38 will swing between 40 KV and 39,990 volts. In order to accomplish this, a control voltage applied to conductor 48 is varied between about 5 to 10 volts positive and ground potential. When conductor 48 is at ground potential, all of the transistors that form string 18 are biased nonconductive so that the voltage at junction 38 is approximately 40 KV. When a positive voltage of about ten volts is applied to conductor 48, all of the transistors that make up string 18 are biased slightly conductive. In this regard, the resistor 42 acts as a source follower providing negative feedback to the string, which limits the current in the string 18 to a sub-threshold level. Putting it another way, the gate to source voltages of the transistors that make up string 18 d not reach a certain threshold gate voltage so the transistors are only slightly conductive. Accordingly, the voltage at junction 38 drops only slightly from 40 KV to 39,990 volts when the voltage applied to conductor 48 is about 5 to 10 volts positive.

The voltage at junction 38, and hence on conductor 58, determines the switching state of the series connected transistors that form string 50. When the voltage at junction 38 is 40 KV, all of the transistors of string 50 are biased nonconductive. When the voltage at junction 38 goes to 39,990 volts, all of the transistors of string 50 are biased fully conductive.

The purpose of string 70 is to periodically pull down the conductor 60 to ground potential or in other words, to periodically connect conductor 60 to ground. When conductor 88 is connected to ground potential, all of the transistors that form string 70 are biased fully conductive so that the drain-source circuits of these transistors connect conductor 60 to ground. When a voltage of about a negative five volts is applied to conductor 88, all of the transistors that form the string 70 are biased fully nonconductive between their respective drain and source electrodes.

The purpose of the string 70 is to assure that the line 60 is pulled down to ground potential whenever it is desired that there be no output on line 60. Thus, even when the string 50 is biased nonconductive, there may be some leakage current through this string and which, in the absence of string 70, could cause the spark plug 12 to be energized when it should be deenergized.

A switching circuit that is synchronized to engine piston position for applying control voltages to control lines 48 and 88 will now be described. In FIG. 1, two cam operated switching devices are shown. One of these switching devices comprises a movable contact 90 that is connected to control line 48. This movable contact is moved by a cam 92 connected to a shaft 94. The shaft 94 is driven by the camshaft of engine 10 so that shaft 94 is driven at one-half engine crankshaft speed. The cam 92 causes contact 90 to be engaged with either fixed contact 90A or 90B. Fixed contact 90A is connected to the positive terminal of a direct voltage bias source 96 which may have a terminal voltage of about 5 to 10 volts. Fixed contact 90B is connected to ground.

The switching device that controls the control voltage that is applied to line 88 comprises a movable contact 98 that is connected to line 88. This movable contact is moved by another cam 100 connected to shaft 94. The cam 100 causes movable contact 98 to be engaged with either fixed contact 98A or 98B. Fixed contact 98A is connected to the negative terminal of a direct voltage bias source which may have a terminal voltage of about five to ten volts. Fixed contact 98B is grounded.

The cams 92 and 100 each have single lobes which are aligned. Further, contacts 90 and 98 can be spring biased to their normally closed positions shown in FIG. 1 where movable contact 90 engages contact 90B and movable contact 98 engages fixed contact 98B. At a certain rotative position of shaft 94, the cams 92 and 100 will cause contact 90 to engage contact 90A and contact 98 to engage contact 98A. Since the lobes on the cams are aligned, contact 90 will engage contact 90A substantially at the same time that contact 98 engages contact 98A.

With the foregoing in mind, the sequential firing of spark plug 12 will now be described. Assume that cams 92 and 100 are in a position where contact 90 engages contact 90B and contact 98 engages contact 98B. Both control lines 48 and 88 are now grounded. This being so string 18 is biased nonconductive so the voltage at junction 38 goes to 40 KV. This causes the string 50 to be biased nonconductive. Since control line 88 is now grounded, string 70 is biased conductive to pull down line 60 to ground. There is no output on line 60 and accordingly there is no spark firing voltage applied to spark plug 12.

When spark plug 12 should be fired, shaft 94 will have rotated to a position wherein the cam lobes cause contact 90 to engage contact 90A and contact 98 to engage contact 98A. The string 18 will now be biased slightly conductive, as previously explained, so that the voltage at junction 38 goes from 40 KV to 39,990 volts. This causes string 50 to be biased conductive. At the same time the engagement of contact 98 with contact 98A causes string 70 to be biased nonconductive. A spark plug firing voltage is now developed on line 60 which causes spark plug 12 to fire.

Figure 2:
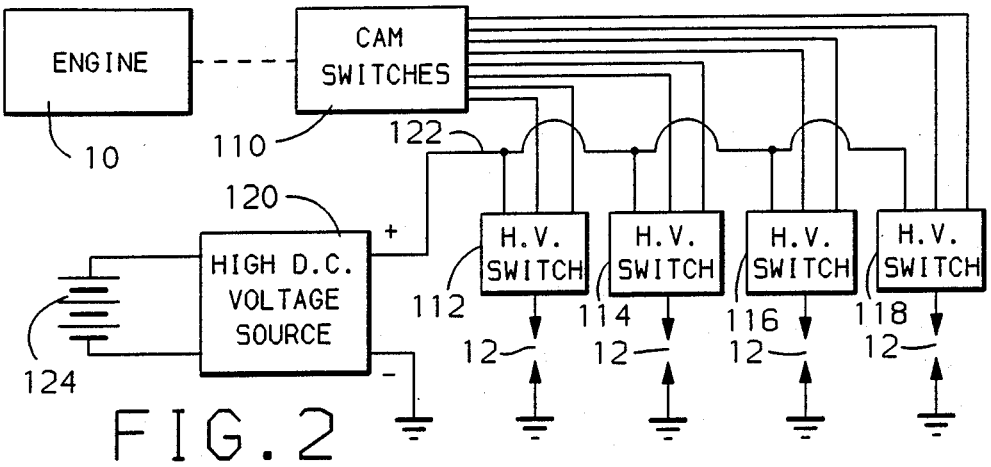
FIG. 2 illustrates an ignition system for a multi-cylinder engine that uses the circuitry shown in FIG. 1.

FIG. 2 illustrates an ignition system for a four cylinder engine that utilizes the strings of transistors shown in FIG. 1. The camshaft of engine 10 operates cam switches which are shown as a block 110. The cam switches 110 can be of the same type as those shown in FIG. 1 and are actuated by cams like cams 92 and 100. Eight cam operated switches are used, four for each cam. The cam operated switches are arranged such that they are located 90 degrees apart and accordingly a cam operated switch is actuated at each 90 degrees of rotation of the engine camshaft.

In FIG. 2, four high voltage switches, 112, 114, 116 and 118 are shown connected respectively to four spark plugs 12. Each of these high voltage switches includes the three strings of transistors 18, 50 and 70, shown in FIG. 1. These strings of transistors are controlled by the eight conductors or lines shown in FIG. 2 that connect cam switches 110 to the respective high voltage switches. Two control lines, which correspond to control lines 48 and 88 of FIG. 1, are connected between a respective high voltage switch and cam switches 110.

The system of FIG. 2 has a high voltage direct voltage source 120. The positive output terminal of this source is connected to the high voltage switches 112–118 by conductor 122 and its negative output terminal is grounded. The source 120 may take the form of a DC to DC converter that receives input power from a 12 volt motor vehicle storage battery 124.

Figure 3:
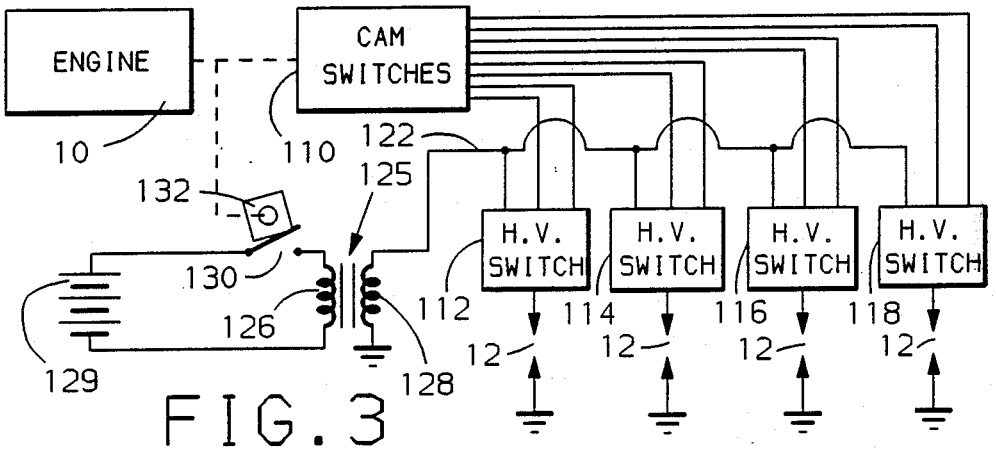
FIG. 3 illustrates an ignition system that is similar to the system shown in FIG. 2 wherein spark plug firing voltages are developed by an ignition coil.

The ignition system of FIG. 3 is a modification of the system shown in FIG. 2. In FIG. 3, the high voltage source 120 has been replaced by voltage developing apparatus that includes an ignition coil 125 having a primary winding 126 and a secondary winding 128. The secondary winding 128 feeds the high voltage switches 112–118 via conductor 122. The primary winding 126 is connected to a 12 volt direct voltage source 129 through a switch or breaker contact 130 operated by four lobed cam 132. The cam 132 is driven by the camshaft of engine 10.

When switch 130 is closed, the primary winding 126 is energized and when switch 130 opens, a high voltage is developed in secondary winding 130 which is applied to one of the spark plugs 12 via one of the high voltage switches 112–118. In the system of FIG. 3 the high voltage switches 112–118 operate as an electronic distributor for sequentially applying the voltage developed in secondary winding 128 to the spark plugs.

It will be appreciated that the system of FIG. 3 develops a series of high direct voltage pulses which are respectively directed to the proper spark plugs by high voltage switches 112–118. On the other hand, in the system of FIG. 2, a continuous direct voltage is applied to switches 112–118. In the system of FIG. 2, the periods of times that respective switches 112–118 are biased conductive could be controlled to thereby control spark plug arc duration.

Figure 4:
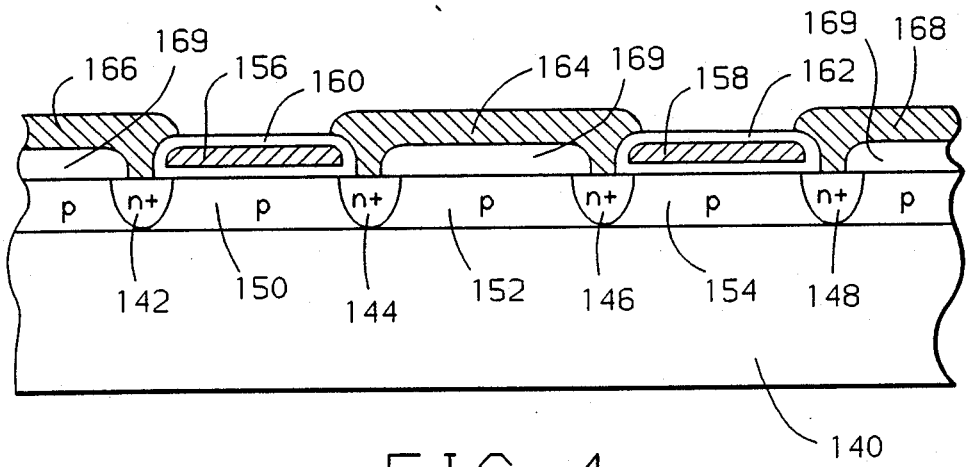
FIG. 4 is a sectional view of a solid state switch that is used in the systems shown in FIGS. 1–3.

The strings 18, 50 and 70 of FIG. 1 are preferably manufactured by integrating the transistors that make up a string on an insulating substrate. The insulating substrate maintains isolation among the transistors in the string. FIG. 4 illustrates, in section, the manner in which the N-channel enhancement mode transistors that form string 18 can be integrated into one unit. In FIG. 4, reference numeral 140 designates a substrate that is formed of insulating material such as sapphire. The substrate 140 carries zones 142, 144, 146 and 148 of n+type semiconductor material and zones 150, 152 and 154 of p-type semiconductor material. Reference numerals 156 and 158 respectively designate contacts or plates that are the gate electrodes of two adjacent transistors. Contacts 156 and 158 are surrounded by zones 160 and 162 of silicon dioxide. The n+zones 144 and 146 are electrically connected by a metallic conductor 164 and other n+zones are respectively connected by metallic conductors 166 and 168. The conductors 164, 166 nd 168 extend over zones of silicon diode 169. In FIG. 4, zones 142 and 146 are drain electrodes. Zones 144 and 148 are source electrodes. Conductor 164 connects zone 144 (source) to zone 146 (drain). This connection pattern is the same for the entire device shown in FIG. 4 and the connection pattern is the same as the connection pattern shown in FIG. 1 for string 18, that is the source of a given transistor is connected to the drain of an adjacent transistor. There may be several thousand transistors mounted on a common substrate 140, all connected in series in a manner that has been described. Further, the resistors that form voltage divider 26 can be supported by substrate 140.

The transistors that form strings 50 and 70 can be integrated on a substrate in the same general manner as has been described for the integration of string 18 but with appropriate use of certain types of semiconductor materials for the zones to form p-channel enhancement mode transistors for string 50 and N-channel depletion mode transistors for string 70.

In FIG. 1, cam operated switches are shown for controlling the control voltages applied to lines 48 and 88 and in FIG. 3, a cam operated switch 130 is shown for switching primary winding current. These switches can take the form of semiconductor switches that are controlled, for example, by a voltage developed in a magnetic pick-up coil. The pick-up coil would generate a voltage in response to rotation of a slotted disk that is driven by the engine such that the voltage generated would represent engine camshaft position. Such devices are well known to those skilled in the art.

In describing this invention it was assumed, for example, that the source of high direct voltage had an output voltage of 40 KV. This voltage may be lower than 40 KV but must be high enough to create an arc across the electrodes of the spark plugs. Since spark plugs can require at least 15 KV to breakdown the spark plug gap, the voltage of the source has to be higher than 15 KV.

When using the systems shown in FIGS. 1 and 2, the DC voltage sources should be so-called soft voltage sources that tend to decrease in output voltage once a spark plug is fired to draw current from the voltage source. This decreasing voltage characteristic can also be provided by a resistor.

It will be apparent that the purpose of the voltage dividers 26, 56 and 70 is to provide proper gate bias voltage levels to the gates of the respective strings of transistors 18, 50 and 70.

The embodiments of the invention in which an exclusive property or privilege is claimed are defined as follows:

1. An ignition system for a spark ignited internal combustion engine comprising, an internal combustion engine, a spark plug for igniting the combustible mixture in a cylinder of said engine, a source of direct voltage having a magnitude that is high enough to cause said spark plug to fire when applied to said spark plug to ignite said combustible mixture, a high voltage semiconductor switch connected between said source of voltage and said spark plug, said semiconductor switch comprising a plurality of series connected transistors, each of said transistors having two current carrying electrodes and a control electrode, the current carrying electrodes of said transistors being connected in series, a voltage divider having a plurality of junctions, means connecting respective control electrodes of said transistors to respective junctions of said voltage divider, and means coupled to a movable part of said engine and to said voltage divider for causing said transistors to be biased alternately conductive and nonconductive.

2. An ignition system for a spark ignited internal combustion engine comprising, an internal combustion engine, a spark plug for igniting the combustible mixture in a cylinder of said engine, a source of direct voltage having a magnitude that is high enough to cause said spark plug to fire when applied to said spark plug to ignite said combustible mixture, a high voltage semiconductor switch connected between said source of voltage and said spark plug, said semiconductor switch comprising a plurality of series connected field effect transistors, a voltage divider having a plurality of junctions, means connecting respective gate electrodes of said transistors to respective junctions of said voltage divider, and means coupled to a movable part of said engine and to said voltage divider for causing said transistors to be biased alternately conductive and nonconductive.

3. The ignition system according to claim 2 where all of said series connected field effect transistors are supported by a common substrate that is formed of electrical insulating material.

4. An ignition system for a spark ignited internal combustion engine comprising, a spark plug for igniting the combustible mixture in a cylinder of said engine, a source of direct voltage having a magnitude that is high enough to cause said spark plug to be fired when applied thereto, a first string of transistors comprising a plurality of first transistors each having a pair of current carrying electrodes and a control electrode, the current carrying electrodes of said first transistors being connected in series, means connecting said first string of transistors between said voltage source and said spark plug, a second string of transistors comprising a plurality of second transistors each having a pair of current carrying electrodes and a control electrode, the current carrying electrodes of said second transistors being connected in series, means connecting said second string of transistors in parallel with said spark plug, and means coupled to a movable part of said engine and to the control electrodes of said first and second strings of transistors for at times causing said first string of transistors to be biased conductive and said second string of transistors nonconductive and for at other times causing said first string of transistors to be biased nonconductive and said second string of transistors conductive.

5. An ignition system for a spark ignited internal combustion engine comprising, a spark plug for igniting the combustible mixture in a cylinder of said engine, a source of direct voltage having a magnitude that is high enough to cause said spark plug to be fired when applied thereto, a first string of field effect transistors comprising a plurality of first field effect transistors that are all connected in series, means connecting said first string of transistors between said voltage source and said spark plug, a second string of field effect transistors comprising a plurality of second field effect transistors that are all connected in series, means connecting said second string of transistors in parallel with said spark plug, and means coupled to a movable part of said engine and to the gate electrodes of said first and second strings of transistors for at times causing said first string of transistors to be biased conductive and said second string of transistors nonconductive and for at other times causing said first string of transistors to be biased nonconductive and said second string of transistors conductive.

6. The ignition system according to claim 5 where said source of direct voltage comprises an ignition coil having primary and secondary windings, said primary winding being connected to a source of low direct voltage through a switching means, said secondary winding developing a high voltage when said switching means opens.

7. The ignition system according to claim 5 where said first transistors are all P-channel enhancement mode type of transistors and said second transistors are all N-channel depletion mode type of transistors.

8. An ignition system for a spark ignited internal combustion engine comprising, a source of high direct voltage having first and second output terminals, a spark plug for said engine, means connecting said first output terminal of said source to a first side of said spark plug, a first string of field effect transistors comprising a plurality of first field effect transistors that are all connected in series, a first voltage divider having a plurality of junctions, means connecting respective gate electrodes of said first transistors to respective junctions of said first voltage divider, means connecting said first string of transistors between said second output terminal of said voltage source and a second side of said spark plug, a second string of field effect transistors comprising a plurality of second field effect transistors that are all connected in series, a second voltage divider having a plurality of junctions, means connecting respective gate electrodes of said second transistors to respective junctions of said second voltage divider, means connecting said second string of transistors in parallel with said spark plug, and control means coupled to said first and second voltage dividers and driven by said engine operative during a first mode of operation to cause said first string of transistors to be biased conductive and said second string of transistors nonconductive and operative during a second mode of operation to cause said first string of transistors to be biased nonconductive and said second string of transistors conductive.

9. An ignition system for a spark ignited internal combustion engine comprising, a spark plug for igniting the combustible mixture in a cylinder of said engine, a source of direct voltage having a magnitude that is high enough to cause said spark plug to be fired when applied thereto, a first string of field effect transistors comprising a plurality of first field effect transistors that are all connected in series, means connecting said first string of transistors between said voltage source and said spark plug, a second string of field effect transistors comprising a plurality of second field effect transistors that are all connected in series, means connecting said second string of transistors across said source of direct voltage, means coupled to a movable part of said engine and to the gate electrodes of said second string of transistors for causing said second string of transistors to be biased either slightly conductive or nonconductive, and means coupling said second string of transistors to said first string of transistors such that when said second string of transistors are biased nonconductive, said first string of transistors is biased nonconductive and such that when said second string of transistors is biased slightly conductive, said first string of transistors is biased conductive.

* * * * *